United States Patent [19]

Musci

[11] 4,409,745

[45] Oct. 18, 1983

[54] INSOLE SYSTEM FOR SHOE WITH REMOVABLY-MOUNTED HEEL

[75] Inventor: Nicola Musci, Caracas, Venezuela

[73] Assignee: Fratelli Musci, Caracas, Venezuela

[21] Appl. No.: 352,881

[22] Filed: Feb. 26, 1982

Related U.S. Application Data

[63] Continuation-in-part of Ser. No. 300,515, Sep. 9, 1981.

[51] Int. Cl.[3] ..... A43B 13/28; A43B 21/36

[52] U.S. Cl. ..... 36/24.5; 36/42; 36/43; 12/142 J

[58] Field of Search ..... 36/42, 24.5, 36 R, 36 C, 36/100, 43; 12/142 J

[56] References Cited

U.S. PATENT DOCUMENTS

| | | | |
|---|---|---|---|
| 35,057 | 4/1862 | Boisset | 36/24.5 X |
| 2,114,993 | 4/1938 | Brandt | 36/24.5 |
| 2,544,878 | 3/1951 | Dratler | 36/36 R |
| 2,912,772 | 11/1959 | Harrison | 36/24.5 X |
| 3,099,096 | 7/1963 | Fabian | 36/24.5 |
| 4,320,588 | 3/1982 | Sottolana | 36/24.5 |

FOREIGN PATENT DOCUMENTS

| | | | |
|---|---|---|---|
| 201471 | 2/1956 | Australia | 36/24.5 |
| 1156338 | 10/1963 | Fed. Rep. of Germany . | |
| 2009997 | 9/1971 | Fed. Rep. of Germany | 36/42 |
| 1400932 | 4/1965 | France | 36/24.5 |
| 917582 | 6/1963 | United Kingdom . | |
| 930789 | 7/1963 | United Kingdom | 36/24.5 |
| 1030576 | 5/1966 | United Kingdom . | |
| 1093363 | 11/1967 | United Kingdom . | |
| 1108867 | 4/1968 | United Kingdom . | |
| 1149434 | 4/1969 | United Kingdom . | |

*Primary Examiner*—James Kee Chi

*Attorney, Agent, or Firm*—Cushman, Darby & Cushman

[57] ABSTRACT

A system is provided wherein a dress shoe may be fabricated by even small industrial enterprises or small groups of workers, using four basic components, namely an anatomically-shaped combination insole and heel jack unit, a removable heel with its securement device, an upper and a sole. By preference the insole/-heel jack unit is constituted by a body of plastic material sandwiched between and united to upper and lower layers of sheet material. In the shoe assembly operation, the insole/heel jack unit is inserted into the upper and secured in place with the heel jack exposed below, a sole is laminated to the underside of the forward portion of the upper and a heel of selected height and style is removably secured in place.

12 Claims, 11 Drawing Figures

Fig. 6
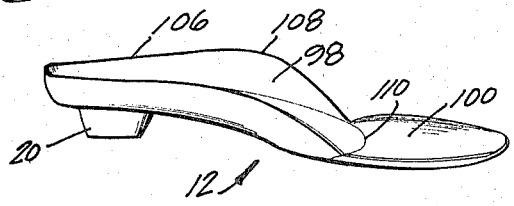
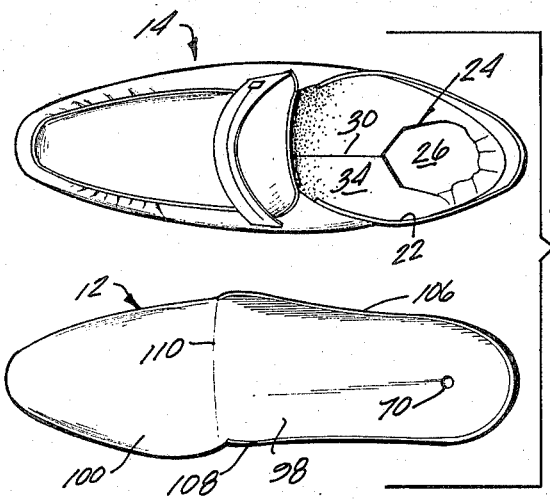
Fig. 7
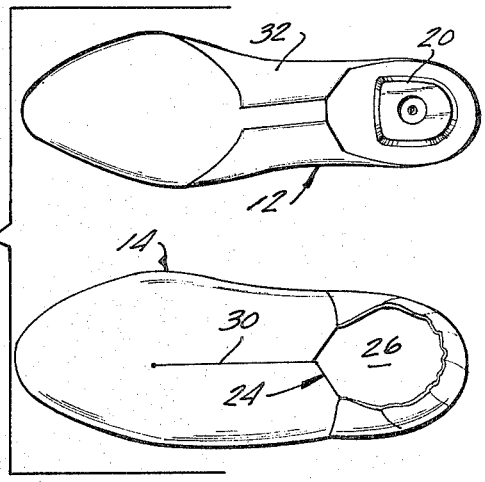
Fig. 8
Fig. 9
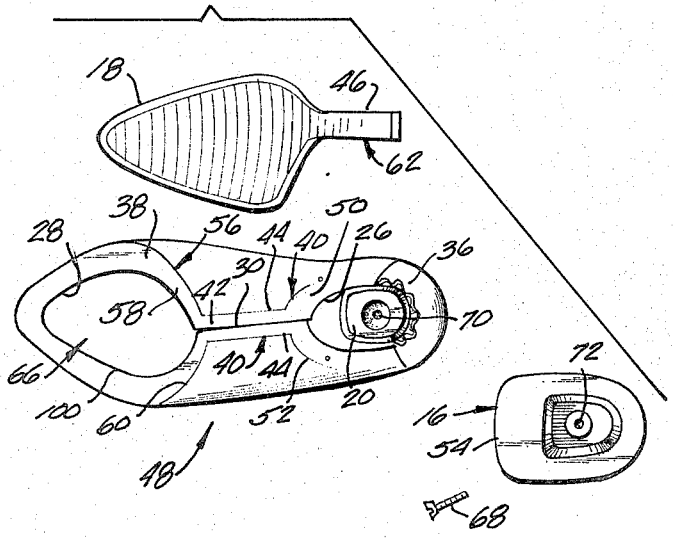

INSOLE SYSTEM FOR SHOE WITH REMOVABLY-MOUNTED HEEL

REFERENCE TO RELATED APPLICATION

This is a continuation-in-part of my copending U.S. patent application Ser. No. 300,515, filed Sept. 9, 1981, entitled Shoe with Removably-Mounted Heel.

BACKGROUND OF THE INVENTION

The fabrication of men's and women's dress shoes and casual shoes today is a capital-intensive business due to the need for expensive machinery and the use of skilled technicians in the step-by-step process of assembly of the shoes from the many individual components. This leads to higher cost shoes, and places a squeeze on the profit margins of the manufacturers and marketers of traditional footwear. It also has put dress shoes at a disadvantage to ones made of plastic, rubber and fabric, e.g., sport shoes worn as casual shoes, to the detriment of the traditional footwear industry.

For the shoe manufacturer, the shoe marketer and the shoe consumer it is considered an advantage to have a basic design of shoe which can be caused to have a substantially different appearance with only a modest expenditure.

Accordingly, various ways and means have been proposed for providing this advantage to one or more of these interests. One way that a basic design of shoe can be substantially changed in appearance is to offer it with various styles, types, colors and/or quality-grades of heel. If the various designs of heel for a basic design of shoe are permanently applied during manufacture of the shoe, then the manufacturer may be the only one to derive a substantial benefit, although the marketer and consumer may be enabled by this rationalization of the manufacturing process to afford a better grade of shoe, if some of the economy is passed on down to the marketer and consumer. It appears that a substantial majority of prior inventions in this field relate to systems in which the heels and heel-needing shoes may be largely separately manufactured, but once assembled to one another at the factory are meant to stay assembled for the life of the shoe. In these cases the shoes are not meant to be easily provided with new or different heels either for fashion or renewal purposes. Thus, the marketers and consumers of shoes have been largely or wholly denied the benefits of being able to substantially alter the appearance of a basic design of shoe by easily selecting a heel to be assembled with a basic design of heel-needing shoe, or to exchange the existing heel with another which looks different, is newer, is higher or lower, is more elegant or more sporty, is slimmer or more blocky, is of one color or another, is make of a more or less expensive covering material, matches one wardrobe, or another, and the like.

Accordingly, in my earlier-filed, copending U.S. patent application, Ser. No. 300,515, I have described a shoe with a removably mounted heel. According to my earlier invention, a basic design of heel-needing shoe is provided having a sole member made of semi-rigid molded plastic material including a thickened heel stub or jack portion having a downwardly-tapering outer perimetrical sidewall extending about the back and the lateral sides, and a downwardly-opening cylindrically-walled centrally-located socket. The upper surface of the sole member overlying this thickened portion is preferably provided with a small-diameter opening axially communicating with the wall. The upper end of the heel is provided with a centrally located axially upwardly projecting cylindrical boss, preferably centrally provided with an upwardly opening threaded bore. The boss is surrounded by a flat upper end surface. An upstanding flange extends about the back and sides of this end surface. The inner surface of this flange tapers to match the heel jack. The heel is disassembly assembled to the basic heel-needing shoe by inserting the heel boss into the jack socket and threading a screw through the sole opening into the boss bore. Two designs of shoe/-heel visible interface are shown.

SUMMARY OF THE INVENTION

A system is provided wherein a dress shoe may be fabricated by even small industrial enterprises or small groups of workers, using four basic components, namely an anatomically-shaped combination insole and heel jack unit, a removable heel with its securement device, an upper and a sole. By preference the insole/-heel jack unit is constituted by a body of plastic material sandwiched between and united to upper and lower layers of sheet material. In the shoe assembly operation, the insole/heel jack unit is inserted into the upper and secured in place with the heel jack exposed below, a sole is laminated to the underside of the forward portion of the upper and a heel of selected height and style is removably secured in place.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWING FIGURES

In the Drawings

FIG. 6 is a perspective view of the insole/heel jack unit of FIG. 3 looking toward the lateral side thereof;

Figure 10:
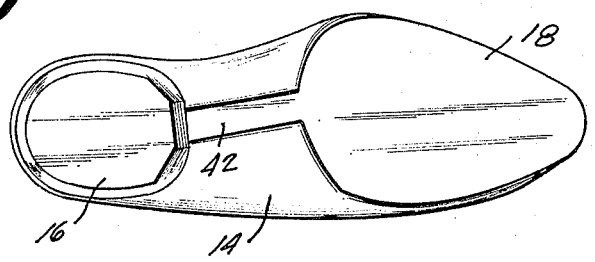

FIG. 7 presents side-by-side top plan views of the insole/heel jack unit and the shoe upper in which it is to be inserted;

FIG. 8 represents side-by-side bottom plan views thereof;

FIG. 9 presents side-by-side a bottom plan view of the sub-assembly of the insole/heel jack unit and the shoe upper of FIGS. 7 and 9, with top plan views of the heel and outer sole with a perspective view of the heel-securement screw, all to be assembled together in fabricating the shoe;

FIG. 10 is a bottom plan view of the shoe as assembled; and

Figure 11:
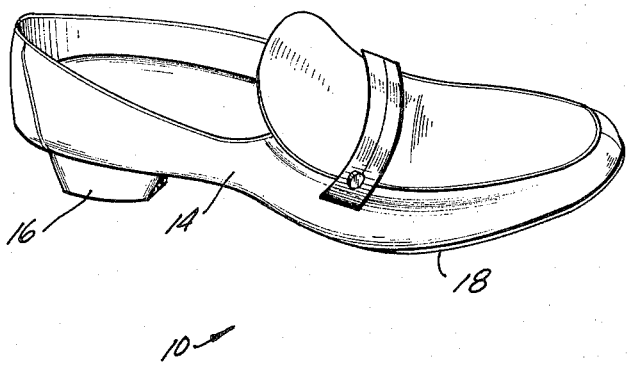

FIG. 11 is a perspective view thereof.

DETAILED DESCRIPTION

Figure 1:
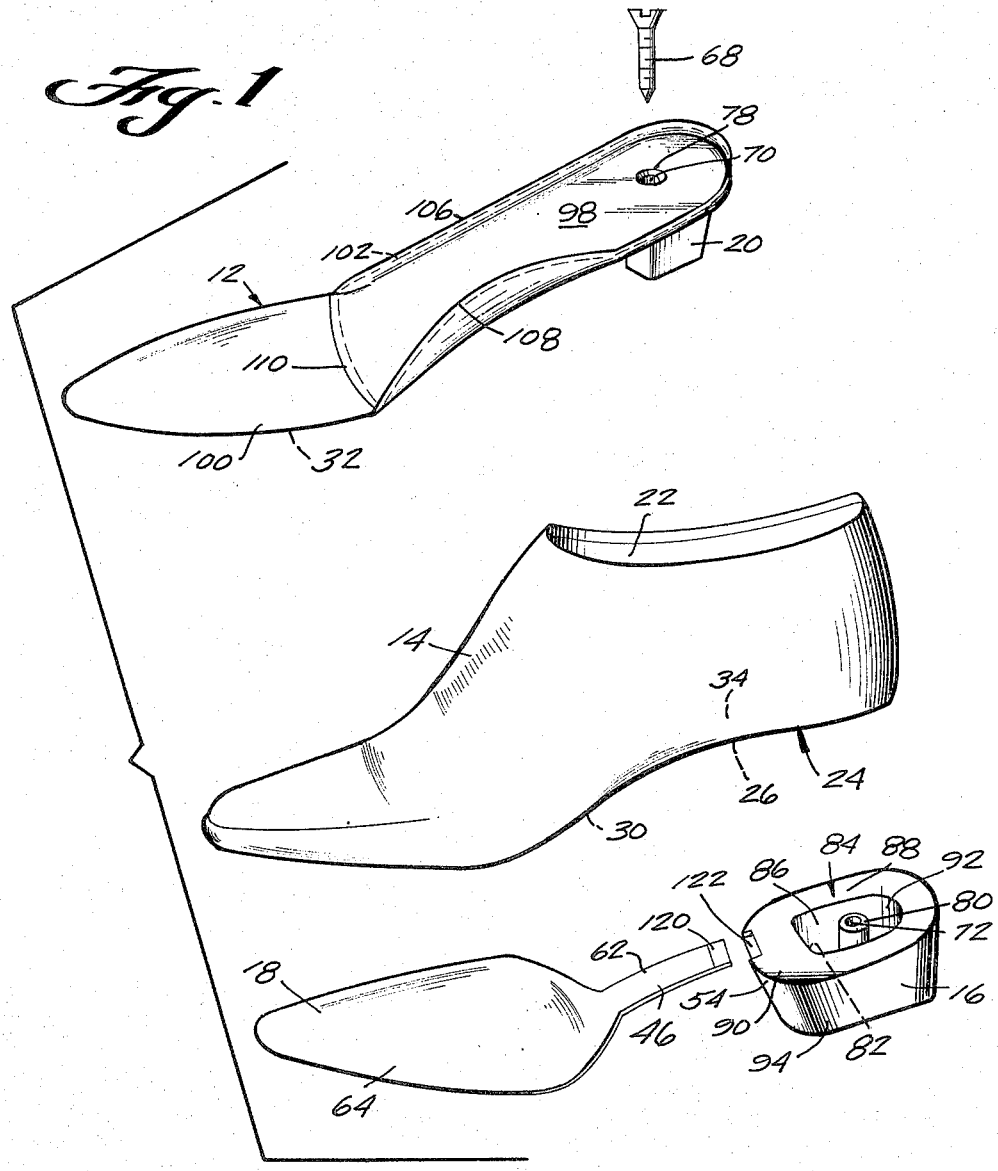
FIG. 1 is an exploded perspective view of a first embodiment of a shoe with a removably-mounted heel provided with an insole system in accordance with the principles of the present invention.

In FIG. 1, all four major components of the shoe 10 are shown, the inner sole/heel jack unit 12, the upper 14, the heel 16 and the outer sole 18.

The unit 12 is a new development of the present invention. The shoe upper 14 may be utterly conventional, e.g., made of leather with or without a conventional lining or partial lining. The heel 16 and the manner of its association with and connection to the heel jack 20 of the inner sole/heel jack unit 12 may be exactly as described in my aforementioned copending U.S. patent application Ser. No. 300,515.

In general, in practicing the invention, a shoe upper 14 is completely made by known means. Accordingly, the shoe upper 14 has a top opening 22 through which the wearer's foot protrudes into and out of the shoe when the shoe is in use. It is also this opening 22 through which the inner sole/heel jack unit 12 will be inserted in assembling the shoe. The shoe upper 14 further includes a lower opening 24 having a rear lobe 26 located centrally of the foot heel region, a forward lobe 28 located centrally of the foot ball and the toe region, and a longitudinal central slit 30 running along the middle of the bottom of the shoe upper 14 between the opening portions 26 and 28.

The rear lobe of the lower opening is large enough that when the inner sole/heel jack unit is inserted into place in the upper the heel jack 20 protrudes down through it for access from below the bottom of the upper 14.

In assembling the inner sole/heel jack unit 12 to the upper, at least one of the underside 32 of the inner sole/heel jack unit 12 and the interior surface 34 of the bottom wall of the shoe upper is coated with any suitable adhesive that is conventionally used in the manufacture of shoes. The adhesive is spread only in what will become the interfacial region, that is everywhere except where the openings 26 and 28 are located. This does include the margin 36 about the opening 26 and the margin 38 about the opening 28.

Figure 2:
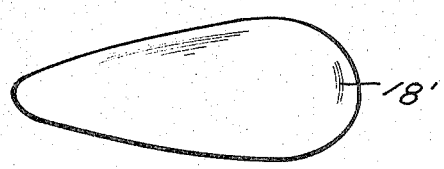
FIG. 2 is a perspective view of an alternative outer sole for the shoe of FIG. 1.
Figure 3:
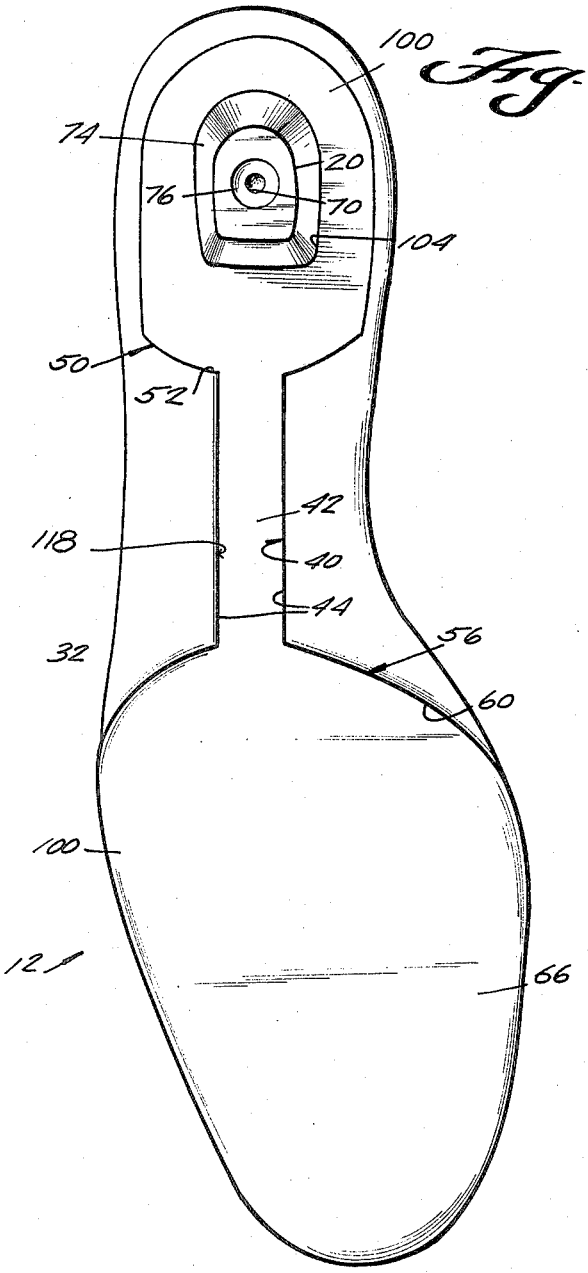
FIG. 3 is a bottom plan view of the insole/heel jack unit of FIG. 1.
Figure 4:
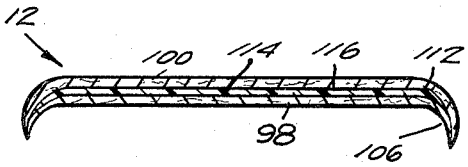
FIG. 4 is a transverse sectional view thereof on line 4—4 of FIG. 3.

Using known pressing machinery conventionally used in the manufacture of shoes, the upper 14 is clamped to the underside of the inner sole/heel jack unit 12 by platen means, not illustrated, which leave a pattern of indentations 40, as seen in FIG. 9. The pattern of indentations 40 is shown including a central portion 42 including the slit 30 and having its delimiting lines 44 flanking and generally paralleling the slit 30, which is wide enough to receive the arch portion 46 of the shoe outer sole 18 when the shoe outer sole 18 has an arch portion. As shown in FIG. 2, the shoe outer sole 18 may lack any such portion, in which case the corresponding central portion 42 of the indentation may simply be omitted, i.e., left not indented, or it may be provided as shown and simply left unfilled as the sole is assembled to the underside of the shoe upper/inner sole/heel jack sub-assembly 48. At the rear, the pattern includes an arcuate portion 50 which contains the forward quarter of the margin 36 and has delimiting lines 52 which will form a jig for uniformly locating the forward edge 54 of the heel 16. Lastly, the pattern 40 of indentations includes at its forward extent an arcuate portion 56 which contains the rear quarter of the margin 58 and has delimiting lines 60 which will form a jig for uniformly locating the shoe sole, whether it is a sole 18 with an arch tab 62 received in the indentation central portion 42 or a sole 18′ which has no arch tab 62.

In any event, during further assembly of the shoe 10, at least one member of what will become the interface between the upper side 64 of the shoe outer sole and the lower side 66 of the corresponding portion of the sub-assembly 48 is spread with a suitable adhesive of a kind conventionally used in shoe manufacture and the two are pressed together and held to unit the outer sole to the unit 12/shoe upper sub-assembly 48.

Assembly of the shoe 10 is completed by fitting a heel 16 onto the heel jack 20 and securing it in place from inside the shoe by downwardly installing a screw 68 through an opening 70 that is provided vertically, centrally through the unit 12 and its heel jack 20. The screw 68 threads into an upwardly opening, internally threaded socket 72 provided centrally in the upper side of the heel 16.

The way that the heel 16 and heel jack 20 are configured is substantially as is described in relation to the comparable structures that are shown in my aforementioned copending U.S. patent application Ser. No. 300,515, given that in the latter application the heel jack 20 is provided on the outer sole member rather than on an inner sole member. Suffice it to describe here, that the inner sole/heel jack unit 12 is, for the most part, a relatively thin member, with a thickened heel stub or jack 20 protruding downwards from its underside in the heel area near its rear. The heel jack 20 has a generally downwardly-tapering outer perimetrical sidewall 74 extending about the front, sides and back so as to have a non-circular horizontal cross-sectional profile, e.g., a profile that is roughly D-shaped. This thickening is shown provided with a downwardly opening, cylindrically-walled, centrally-located socket 76. The body of the unit 12, axially centrally of the roof of the socket is provided with a small-diameter opening 70 having an upwardly-presented, conically-flared mouth 78. Further, the upper end of the heel 16 is provided with a centrally located, axially upwardly projecting cylindrical boss 80, which is provided with the aforementioned threaded bore 72. The base of the boss 80 is surrounded by a flat upper end surface 82 which, in turn, is surrounded by an upstanding annular flange 84. The inner surface 86 of this annular flange 84 tapers to match the outer peripheral sidewall of the heel jack. The upper end surface 88 of the annular flange 84 is generally concave upwards generally spherically, except towards the front at 90 where it is concave upwards generally cylindrically.

The heel 16 is disassembly assembled to the underside of the sub-assembly 48 by inserting the heel boss 80 into the heel jack socket which is, in turn, received in the heel annular socket 92 defined between the boss 80 and flange 84 sidewall 86. Then the screw 68 is threaded downwardly until its head is recessed in or is flush in the mouth 78 of the opening 70 and the threads of the screw 68 are engaged in the socket 72 of the heel 16.

The heel 16 can be easily replaced by one that has a similar interface with the sub-assembly 48, even though it is a heel of a different height, or has a different color or texture or decorative surface provided peripherally at 94 on the sidewall thereof. For instance, the heel 14 may be between twenty and eight centimeters in height, be fat, medium or slim, be of a men's or women's style, and be peripherally decoratively wrapped with plastic sheeting, leather or fabric, e.g., to match or contrast with the material used for the outside of the shoe upper and/or to simulate a stacked leather heel.

Preferably the body of the heel 16 is injection molded of the same kind of nylon or other plastic material as is conventionally used in the manufacture of shoe heels. The threaded socket 72 may in such a case be provided as a tubular brass fitting that is inserted in the injection mold, not shown, so as to become embedded in the plastic material of the body of the heel.

By preference, the insole/heel stock unit 12 is prefabricated in the following manner.

There is currently commercially available to the shoe manufacturing industry a paper-like fibrous product, e.g., as sold for insole manufacture under the trade names Texon and Bontex. This sheet material can be die cut and molded between complementary mold halves upon the application of moderate pressure, e.g., ten atmospheres and moderately elevated temperature, e.g., 150° C., whereupon it will keep its molded shape, something like a taco shell.

What is done to produce the unit 12 is to take two respectively properly cut-out layers 98, 100 of the aforementioned moldable, settable insole sheet material and to put both of them into a specifically shaped injection molding cavity, not shown, with the layer 98 against the upper surface of the mold cavity and the layer 100 against the lower surface of the mold cavity. The mold cavity is so shaped that it grips the layers 98 and 100 together in a ring 102 that is generally centered-upon but is spaced radially (laterally) from where the small opening for the screw 68 is provided through the upper layer, and from where the larger opening 104 is provided through the lower layer for downward emergence of the heel jack 20.

The upper and lower surfaces of the injection mold are correspondingly convexly and concavely shaped so as to produce, upon closure of the mold and the conducting of an injection molding operation, of the anatomically-mimetic shape for the insole that is depicted in the drawings, i.e., with a pronounced rim 106 running all the way around the perimeter and being most pronounced from a region comparable to just back of the ball of foot and all the way back around the heel. The tallest part of this rim is at 108 corresponding to the inside of the foot arch.

Figure 5:
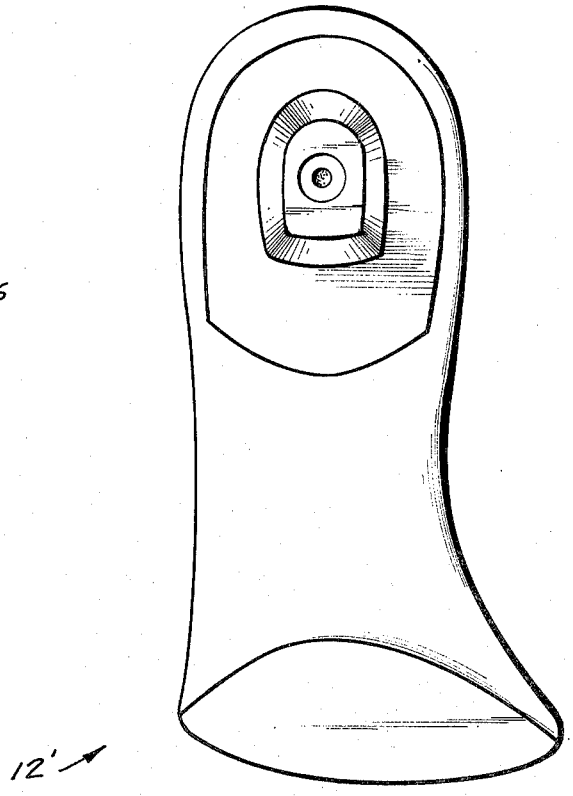
FIG. 5 is a bottom plan view similar to FIG. 3 but of an alternate to the insole/heel jack unit of FIG. 3.

By preference, the layer 98 does not extend forwards much past the ring 102. Its forward edge is shown illustrated at 110. However, for certain shoes, neither layer 98 nor layer 100 need extend forwardly of the ring 102. Such a modification is illustrated at 12' in FIG. 5.

While the layers 98 and 100 are being held in the injection mold, a quantum of plasticized synthetic resin is injected into the mold through either the screw opening in the layer 98 or the jack opening in the layer 100. This plastic material forms a thin lens-like layer 112 between the layers 98 and 100 within all the area bounded by the ring 102, i.e., nearly to the front edge of the layer 98 and to within about a millimeter of the crest of the rim 104. The plastic material also flows out the opening in the layer 100 into a correspondingly shaped portion of the lower mold that forms the heel jack 20. If considered necessary for strength in the heel jack area a brass, aluminum or other metal insert may be inserted into the mold so as to become embedded in the plastic. Once the plastic is injected into the pocket 114 forming the lens-like base 112 and the heel jack 20, and the layers 98, 100 are anatomically-mimetically molded, the plastic material is allowed to cool, cure or set so as to unite the layers 98 and 100 together to the plastic body 116 of the base 112/heel jack 20 as a unitary member 12 having the shape shown, then this member 12 can be removed from the mold.

The mold used to form the unit 12 preferably has the lower surface thereof configured not only to make the lower layer 100 assume a downwardly convex shape, but also to form therein a pattern 118 of indentation that corresponds to the pattern 40 that was described hereinbefore. In fact, the pattern 40 may be formed by forcing the corresponding portions of the underside of the shoe upper to conform to the pattern 118 as the shoe upper is assembled to the unit 12.

For the plastic of the body 116 there is preferably used the same kind of nylon, ABS, rigid polyurethane or the like as is conventionally used in the manufacture of stiffly flexible molded insoles and outer soles of dress shoes.

As an alternative, the body 116 may be preliminarily injection molded so as to have substantially the shape shown, then united to the layers 98, 100 in a simpler press, with or without the use of added adhesive.

The outer sole of the shoe 10 preferably is made of conventionally-used shoe outer sole material such as PVC, TR or leather. When the sole 18 is provided with a rearwardly-projecting arch portion 46 to be received in the central portion 42 of the indentation in the underside of the sub-assembly 48, it is preferably so long that its feathered-in-thickness rear marginal portion 120 becomes covered by the heel 16. If needed or desired, an accommodating notch 122 may be centrally formed in the upper front edge of the heel.

The rim 104 around the edge of the unit 12 may range up to twenty millimeters high, for instance, at 106 and be approximately six to eight millimeters high at the laterally outer corresponding location. In the ball and toe area, the rim 104, if present, may be much less pronounced in height, e.g., up to about two millimeters in height. Similarly, the pattern 118 of indentation in the underside of the insole/heel jack unit 12 is preferably up to about two millimeters in depth.

The shoe 10 provided by the invention is thus easy to assemble of its four main component parts. Embellishments, e.g., a liner, not shown, to cover the heel and arch areas of the foot-supporting upper surface of the insole, and to hide the head of the screw 68 may be provided. The resulting shoe 10 by having a foot-conforming foot-supporting surface helps to provide arch support and lateral support to ease fatigue of the wearer and to correct for minor foot problems such as flat-footedness, allowing the person to walk with more security and firmness.

The shape of the upper surface of the heel corresponds to the shape of the underside of the unit 12/shoe upper 14 sub-assembly 48 over substantially all of the interfacial region where these surfaces abut, in order to provide a strong, attractive construction, yet allow the heel to be changed for cosmetic, renewal or replacement purposes during the useful life of the shoe 10.

It should now be apparent that the insole system for shoe with removably-mounted heel as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An insole system for a shoe with a removably-mounted heel, said insole system comprising:

a unitary insole/heel jack unit having a relatively thin body portion shaped to laterally substantially cover the upper side of the bottom wall of the shoe upper from the back of the heel forwards at least to the arch, said body portion being anatomically-mimetically shaped by being generally upwardly concave/downwardly convex so as to have an upwardly-projecting marginal rim that runs rearwardly at least from the inside of the arch, around back of the heel and forwards at least to the outside of the arch;

said unitary insole/heel jack unit further including a heel jack unitarily formed with said body portion so as to protrude downwardly therefrom centrally of the heel;

said heel jack including means for removably mounting a shoe heel thereto;

said unitary insole/heel jack unit being constituted by a molding of an upper layer and a lower layer of fibrous sheet material with a lens-like pocket of plastic resin encapsulated between them, both layers of sheet material being facially connected to said pocket of plastic resin, the lower of said layers of sheet material having an opening therethrough centrally of the heel; said heel jack being constituted by an integral downward protuberance of said plastic resin from said pocket.

2. The insole system of claim 1, wherein:

said downward protuberance is of non-circular horizontal cross-sectional profile, has an outer peripheral sidewall which tapers downwardly, and has means defining centrally in a lower end thereof a generally cylindrical, downwardly opening socket;

said body portion of said insole/heel jack unit having means defining a small diameter opening therethrough in communication with said socket so that a fastener may be installed downwardly from within the shoe so as to emerge into the socket for connection therein to a removable shoe heel.

3. The insole system of claim 2, further comprising:

a shoe upper having a bottom wall that is provided in the heel with a lower opening;

said insole/heel jack unit being received with said shoe upper with adhesive means being provided between abutting faces of the underside of the body portion of the insole/heel jack unit and the interior of the bottom wall of the shoe upper, and with said heel jack protruding downwardly out of said shoe upper through said lower opening, to form a shoe upper/insole/heel jack unit sub-assembly.

4. The insole system of claim 3, further comprising:

means forming a pattern of indentation in the underside of the sub-assembly for recessedly mounting therein in a uniformly-placed manner at least one of a shoe outer sole and a shoe heel.

5. The insole system of claim 4, wherein:

said pattern of indentation is formed in said insole/-heel jack unit and is consequentially formed in the bottom wall of the shoe upper by conformance therewith.

6. The insole system of claim 4, further including:

a shoe heel removably mounted to said heel jack and having a forward upper edge portion thereof abutted with a corresponding edge portion of said pattern of indentation.

7. The insole system of claim 4, further including:

a shoe outer sole adhesively plated onto the underside of said sub-assembly and having an edge portion thereof abutted with a corresponding edge portion of said pattern of indentation.

8. The insole system of claim 9, wherein:

said edge portion of said shoe outer sole is a rear edge portion thereof.

9. The insole system of claim 7, wherein:

said shoe outer sole includes a relatively broad forward portion with a rear edge portion that is interrupted by a relatively thin, tab-like rearwardly projecting arch-covering portion having a rear marginal edge, said edge portion of said shoe outer sole including laterally opposite side edges of said arch-covering portion.

10. The insole system of claim 9, wherein:

said edge portion of said shoe outer sole further includes said rear edge portion of said forward portion.

11. The insole system of claim 9, further including:

a shoe heel removably mounted to said heel jack and having a forward upper edge portion thereof covering said rear marginal edge of said arch-covering portion of said shoe outer sole.

12. A shoe fabrication system, comprising:

(a) providing as a separate member a shoe heel;

(b) providing as a separate member a shoe outer sole;

(c) providing as a separate member a shoe upper having a bottom wall with an opening formed therethrough in the heel area;

(d) fabricating as a separate member a unitary insole/-heel jack unit having a relatively thin body portion shaped to laterally substantially cover the upper side of the bottom wall of the shoe upper from the back of the heel forwards at least to the arch, said body portion being anatomically-mimetically shaped by being generally upwardly concave/downwardly convex so as to have an upwardly-projecting marginal rim that runs rearwardly at least from the inside of the arch, around back of the heel and forwards at least to the outside of the arch, and a heel jack unitarily formed with said body portion so as to protrude downwardly therefrom centrally of the heel and including means for removably mounting a shoe heel thereto, including molding an upper layer and a lower layer of fibrous sheet material with a lens-like pocket of plastic resin encapsulated between them, both layers of sheet material being facially connected to said pocket of plastic resin, the lower of said layers of sheet material having an opening therethrough centrally of the heel, with said heel jack being constituted by an integral downward protuberance of said plastic resin from said pocket;

(e) inserting the insole/heel jack unit into the shoe upper and securing the underside of the insole/heel jack unit interfacially to the upper side of the bottom wall of the shoe upper with the heel jack of the insole/heel jack unit protruding downwards out of the shoe upper through said opening;

(f) plating the shoe outer sole to the underside of the bottom wall of the shoe upper; and (g) removably mounting the shoe heel to the heel jack of the insole/heel jack unit.

* * * * *